US010034497B1

(12) United States Patent
Jackson

(10) Patent No.: US 10,034,497 B1
(45) Date of Patent: Jul. 31, 2018

(54) INFANT/TODDLER SOCK SYSTEM

(71) Applicant: Rhonda G. Jackson, Temple Terrace, FL (US)

(72) Inventor: Rhonda G. Jackson, Temple Terrace, FL (US)

( * ) Notice: Subject to any disclaimer, the term of this patent is extended or adjusted under 35 U.S.C. 154(b) by 258 days.

(21) Appl. No.: 14/794,145

(22) Filed: Jul. 8, 2015

(51) Int. Cl.

| | |
|---|---|
| ***A41D 27/12*** | (2006.01) |
| ***A41B 11/00*** | (2006.01) |
| ***A41B 11/02*** | (2006.01) |
| ***A43B 17/00*** | (2006.01) |
| ***A43B 17/02*** | (2006.01) |

(52) U.S. Cl.
CPC ..... *A41B 11/02* (2013.01); *A41B 11/002* (2013.01); *A41B 2400/80* (2013.01); *A41B 2500/10* (2013.01); *A41B 2500/20* (2013.01)

(58) Field of Classification Search
CPC ... A41B 11/02; A41B 11/002; A41B 2500/10; A41B 2500/20; A41B 2400/80
USPC ..... 2/61, 239, 240, 241, 242
See application file for complete search history.

(56) References Cited

U.S. PATENT DOCUMENTS 3,146,468 A * 9/1964 McDonald ..... A41B 11/121 2/239
3,983,870 A * 10/1976 Herbert ..... A41B 11/12 2/240
4,277,959 A * 7/1981 Thorneburg ..... A41B 11/02 2/239
5,133,088 A * 7/1992 Dunlap ..... A41B 11/02 2/239
5,771,495 A * 6/1998 Turner ..... A41B 11/00 2/239
5,784,721 A * 7/1998 Huff ..... A41B 11/02 2/239
5,791,163 A * 8/1998 Throneburg ..... A41B 11/02 2/239
6,308,337 B1 * 10/2001 Penley ..... D04B 1/26 2/239
7,421,806 B2 * 9/2008 Braynock ..... A43B 1/0036 2/239
9,364,029 B2 * 6/2016 Patel
2004/0154075 A1 * 8/2004 Ferguson ..... D06F 95/008 2/239
2006/0144097 A1 * 7/2006 Langer ..... A41B 11/00 66/178 R (Continued)

*Primary Examiner* — Clinton T Ostrup
*Assistant Examiner* — Cameron A Carter

(57) ABSTRACT

A sock has a foot portion and an ankle portion. The foot portion has an upper section, a lower section, side sections, an open rear section, and a closed forward toe section. The ankle portion has a top section and a bottom section. A forward friction zone on the foot portion is formed of a plurality of forward threads laterally spaced and extending longitudinally. The forward threads are fabricated of an elastomeric material woven into the lower section and extending rearwardly from the closed forward toe section. The forward threads are coplanar with the lower section. A rearward friction zone on the foot portion is formed of a plurality of rearward threads longitudinally spaced and extending latitudinally. The rearward threads are fabricated of an elastomeric material woven into the lower section and extending forwardly from the open rear section. The rearward threads are coplanar with the lower section.

1 Claim, 2 Drawing Sheets

(56) References Cited

U.S. PATENT DOCUMENTS

| | | | | |
|---|---|---|---|---|
| 2007/0271680 | A1* | 11/2007 | Howell | A41B 11/003 2/239 |
| 2008/0041113 | A1* | 2/2008 | Mori | A41B 11/02 66/54 |
| 2009/0282607 | A1* | 11/2009 | Kaneda | A41B 11/02 2/239 |
| 2009/0288451 | A1* | 11/2009 | Yokoyama | A41B 11/004 66/185 |
| 2010/0043124 | A1* | 2/2010 | Arakelian | A41D 13/06 2/239 |
| 2011/0277218 | A1* | 11/2011 | Padilla | A41B 11/02 2/239 |
| 2013/0232665 | A1* | 9/2013 | Urban | A41B 11/002 2/239 |
| 2014/0053320 | A1* | 2/2014 | Hasan | A41B 11/02 2/239 |
| 2014/0250569 | A1* | 9/2014 | Riley | A41B 11/002 2/239 |
| 2015/0000009 | A1* | 1/2015 | Koshida | A41B 11/00 2/239 |
| 2016/0302491 | A1* | 10/2016 | Campbell | A41B 11/003 |

* cited by examiner

FIG. 1
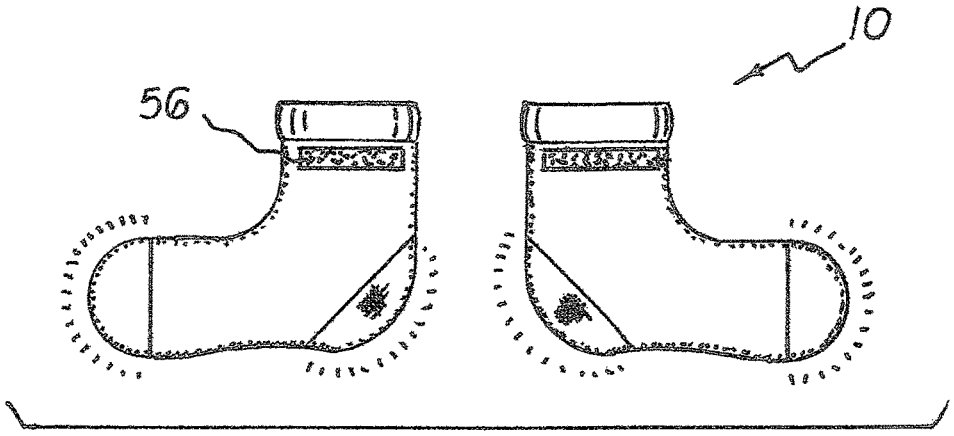
FIG. 2
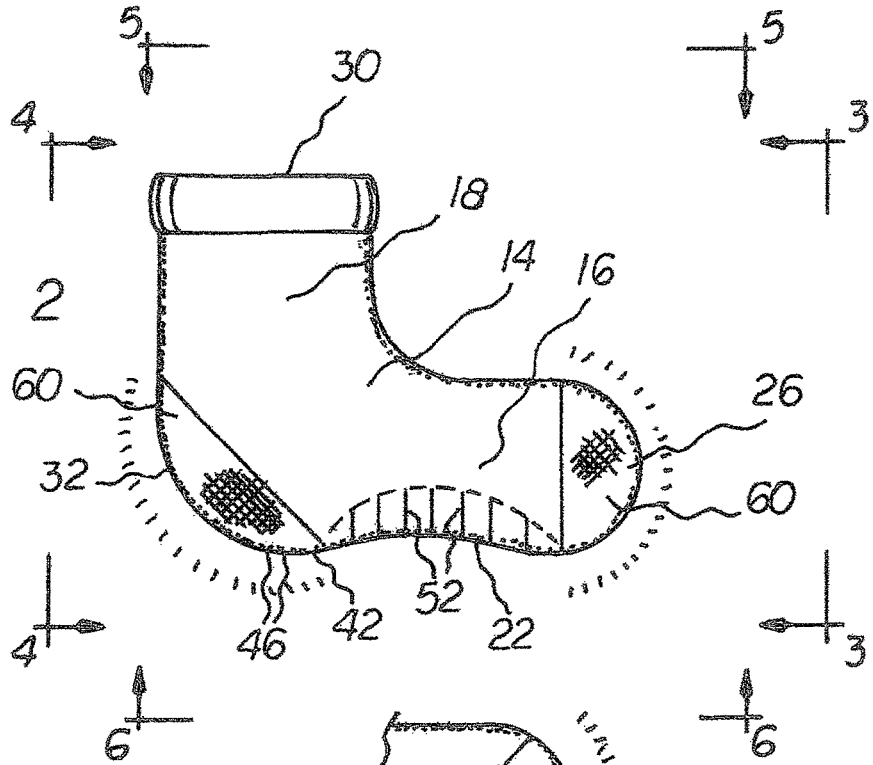
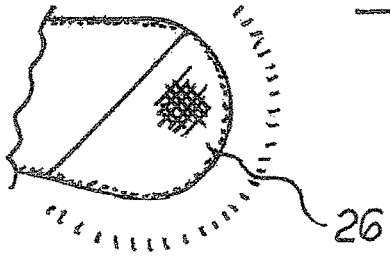
FIG. 2A

FIG. 3
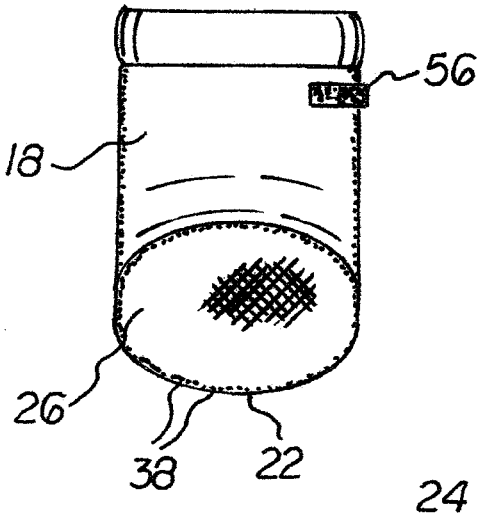
FIG. 4
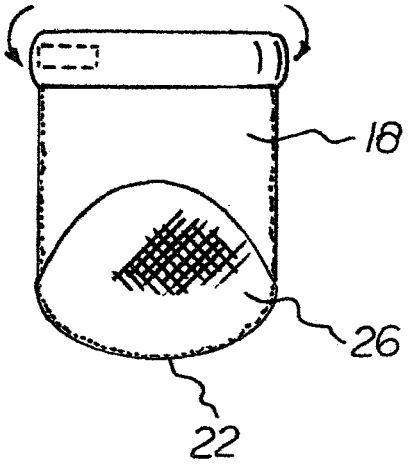
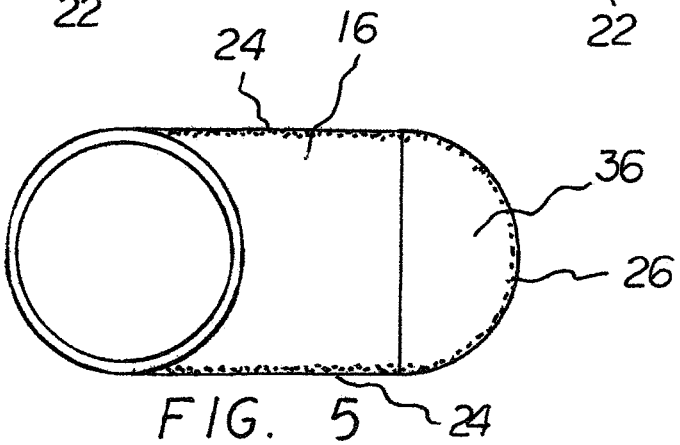
FIG. 5
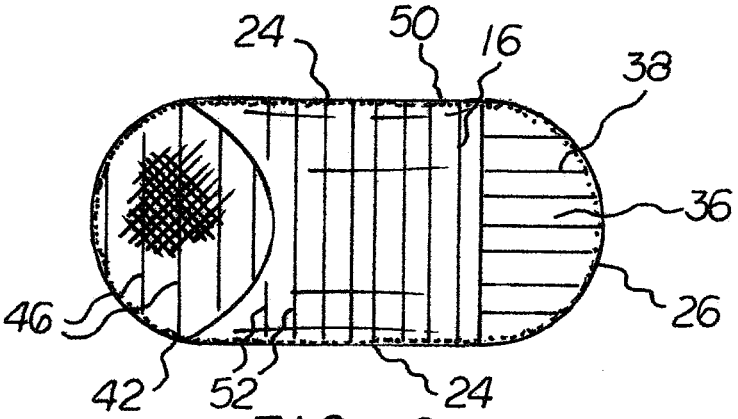
FIG. 6

INFANT/TODDLER SOCK SYSTEM

BACKGROUND OF THE INVENTION

Field of the Invention

The present invention relates to an infant/toddler sock system and more particularly pertains to promoting friction while walking and crawling and for maximizing plantar arch support, the promoting of friction and the maximizing of plantar arch support being done in a safe, convenient and economical manner.

Description of the Prior Art

The use of infant/toddler sock systems of known designs and configurations is known in the prior art. More specifically, infant/toddler sock systems of known designs and configurations previously devised and utilized for the purpose of assisting infants and toddlers in walking are known to consist basically of familiar, expected, and obvious structural configurations, notwithstanding the myriad of designs encompassed by the crowded prior art which has been developed for the fulfillment of countless objectives and requirements.

While these devices fulfill their respective, particular objectives and requirements, they do not describe an infant/toddler sock system that allows for promoting friction while walking and crawling and for maximizing arch support. The promoting of friction and the maximizing of arch support are done in a safe, convenient and economical manner.

In this respect, the infant/toddler sock system according to the present invention substantially departs from the conventional concepts and designs of the prior art, and in doing so provides an apparatus primarily developed for the purpose of promoting friction while walking and crawling and maximizing arch support. The promoting of friction and the maximizing of arch support are done in a safe, convenient and economical manner.

Therefore, it can be appreciated that there exists a continuing need for a new and improved infant/toddler sock system which can be used for promoting friction while walking and crawling and for maximizing arch support. The promoting of friction and the maximizing of arch support being done in a safe, convenient and economical manner. In this regard, the present invention substantially fulfills this need.

SUMMARY OF THE INVENTION

In view of the disadvantages inherent in the types of sock systems of known designs and configurations now present in the prior art, the present invention provides an improved infant/toddler sock system. As such, the general purpose of the present invention, which will be described subsequently in greater detail, is to provide a new and improved infant/toddler sock system and method which has all the advantages of the prior art and none of the disadvantages.

To attain this, the present invention essentially comprises an infant/toddler sock system. First provided in this broad context is a sock having a foot portion and an ankle portion. The foot portion has an upper section, a lower section, and side sections. The side sections are between the upper section and the lower section. The foot portion has an open hindfoot section and a closed forefront section. The ankle portion has a top section and a bottom section. A forefront friction zone on the foot portion is formed of a plurality of forward threads. The elastomeric material is woven into the lower section. The elastomeric material extends rearwardly from the closed forward forefront section. The forward threads are coplanar with the lower section. A rearward friction zone on the foot portion is formed of a plurality of rearward threads. The rearward threads are fabricated of an elastomeric material. The elastomeric material is woven into the lower section. The elastomeric material extends forwardly from the open hindfoot section. The rearward threads are coplanar with the lower section.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the invention be regarded as including such equivalent constructions insofar as they do not depart from the spirit and scope of the present invention.

It is therefore an object of the present invention to provide a new and improved infant/toddler sock system which has all of the advantages of the prior art infant/toddler sock systems of known designs and configurations and none of the disadvantages.

It is another object of the present invention to provide a new and improved infant/toddler sock system which may be easily and efficiently manufactured and marketed.

It is further object of the present invention to provide a new and improved infant/toddler sock system which is of durable and reliable constructions.

An even further object of the present invention is to provide a new and improved infant/toddler sock system which is susceptible of a low cost of manufacture with regard to both materials and labor, and which accordingly is then susceptible of low prices of sale to the consuming public, thereby making such infant/toddler sock system economically available to the buying public.

Lastly, it is an object of the present invention to provide a new and improved infant/toddler sock system for promoting friction while walking and crawling and for maximizing arch support, the promoting of friction and the maximizing of arch support being done in a safe, convenient and economical manner.

These together with other objects of the invention, along with the various features of novelty which characterize the invention, are pointed out with particularity in the claims annexed to and forming a part of this disclosure.

For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a side elevational view of an infant/toddler sock system constructed in accordance with the principles of the present invention.

FIG. 2 is an enlarged side elevational view of one sock of the system shown in FIG. 1.

FIG. 2A is an enlarged side elevational view of an alternate toe section coupled to the foot portion at an angle.

FIG. 3 is a front elevational view taken along line 3-3 of FIG. 2.

FIG. 4 is a rear elevational view taken along line 4-4 of FIG. 2.

FIG. 5 is a plan view taken along line 5-5 of FIG. 2.

FIG. 6 is a bottom view taken along line 6-6 of FIG. 2.

The same reference numerals refer to the same parts throughout the various Figures.

DESCRIPTION OF THE PREFERRED EMBODIMENT

With reference now to the drawings, and in particular to FIG. 1 thereof, the preferred embodiment of the new and improved infant/toddler sock system embodying the principles and concepts of the present invention and generally designated by the reference numeral 10 will be described.

The present invention, the infant/toddler sock system 10 is comprised of a plurality of components. In their broadest context such include a sock, a forefront friction zone, and a rearward friction zone. Such components are individually configured and correlated with respect to each other so as to attain the desired objective.

In the preferred embodiment of the infant/toddler sock system, designated by reference numeral 10, first provided is a sock 14. The sock has a foot portion 16 and an ankle portion 18.

The foot portion has a length. The foot portion is tubular. The foot portion has an upper section 20 and a lower sole section 22.

The foot portion has side sections 24. The side sections are between the upper section and the lower sole section.

The foot portion has a closed forefront section 26 forwardly. The foot portion has an open hindfoot section 28 rearwardly. An alternate embodiment of the toe section is shown in FIG. 2A. In this embodiment, the toe section is coupled to the foot portion at an angle.

The ankle portion is tubular. The ankle portion has an upper top section 30 and a lower bottom section 32.

The ankle portion has a height which is less that the length of the foot portion. The lower bottom section of the ankle portion is integrally fabricated with the open hindfoot section of the foot portion. The foot portion and the ankle portion are knit from a fabric chosen from a class of fabrics including wool, cotton and synthetic fibers and blends thereof.

The lower sole section of the foot portion has a forefront friction zone 36. The forefront friction zone is on the lower sole section of the foot portion. The forefront friction zone is formed of a plurality of forefront threads 38. The forefront threads are laterally spaced. The forefront threads are formed of an elastomeric material. The elastomeric material is woven parallel with the side sections. The elastomeric material extends rearwardly from the closed forefront section. The forefront threads are coplanar with the fabric of the foot portion. In this manner gripping of the system to a floor while crawling and walking is facilitated.

The lower sole section of the foot portion has a rearward friction zone 42 on the lower sole section of the foot portion. The rearward friction zone is formed of a plurality of rearward threads 46. The rearward threads are spaced. The rearward threads are fabricated of an elastomeric material. The elastomeric material is woven perpendicular to the side sections. The elastomeric material extends forwardly from the open hindfoot section. The rearward threads are coplanar with the fabric of the foot portion. In this manner, gripping of the system to a floor while walking is facilitated. The elastomeric material is chosen from a class of elastomers including plastic and rubber, natural and synthetic, and blends thereof.

Provided next is an intermediate support zone 50. The intermediate support zone is on the lower sole section and the side sections of the foot portion. The intermediate support zone is formed of a plurality of support threads 52. The support threads are laterally spaced. The spaced support threads are fabricated of an elastomeric material. The elastomeric material is woven perpendicular to the side sections. The elastomeric material extends between the closed forefront section and the open hindfoot section. The support threads are coplanar with the lower sole section and side sections. In this manner, plantar arch support of the wearer is maximized.

Further provided is a hook and loop patch 56. The hook and loop patch is attached to the ankle portion. The hook and loop patch is beneath the upper top section. In this manner, a pair of the socks is coupled together during washing and storage.

Provided last is luminescent material 60. The luminescent material is in the open hindfoot section and the closed forefront section. In this manner, glowing of the sock to allow finding the sock in the dark is facilitated.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An infant and toddler sock system (10) for promoting friction while walking and crawling and for maximizing arch support, the system consisting of: a sock (14) having a foot portion (16) and an ankle portion (18); the foot portion having a length and being tubular with an upper section (20) and a lower sole section (22); the foot portion having side sections (24) between the upper section and the lower sole section; the foot portion having a closed toe section (26) forwardly and an open rear section (28) rearwardly; the ankle portion being tubular with an upper top section (30) and a lower bottom section (32); the ankle portion having a height less than the length of the foot portion, the lower bottom section of the ankle portion being integrally fabricated with the open rear section of the foot portion, the foot portion and the ankle portion being knit from a fabric chosen from a class of fabrics consisting of wool, cotton and synthetic fibers including blends thereof; a forward friction zone (36) on the lower sole section of the foot portion, the forward friction zone consisting of a plurality of linear laterally spaced forward threads (38) of an elastomeric material woven parallel with the side sections and extending rearwardly from the closed toe section for between 20 and 30 percent of the length of the foot portion and terminating forwardly of a central section, the forward threads being coplanar with the fabric of the foot portion to facilitate gripping of the system to a floor while crawling and walking; and a rearward friction zone (42) on the lower sole section of the foot portion, the rearward friction zone consisting of a plurality of linear longitudinally spaced latitudinal threads (46) of an elastomeric material woven perpendicular to the side sections and extending forwardly from the open rear section for between 20 and 30 percent of the length of the foot portion and terminating rearwardly of the central section, the rearward threads being coplanar with the fabric of the foot portion to facilitate gripping of the system to a floor while walking, the elastomeric material being chosen from a class of elastomers including plastic and rubber, natural and synthetic blends thereof; an intermediate support zone (50) on the lower sole section and the side sections of the foot portion, the intermediate support zone consisting of a plurality of linear support threads (52) laterally spaced and longitudinally extending, the spaced support threads being of an elastomeric material woven perpendicular to the side sections and extending between the closed toe section and the open rear section, the support threads extending for between 40 and 60 percent of the length of the foot portion, the support threads being coplanar with the lower sole section and side sections for maximizing arch support of the wearer; a hook and loop patch (56) attached to the ankle portion beneath the upper top section for coupling a pair of the socks together during washing and storage; and luminescent material (60) in the open rear section and the closed toe section to facilitate glowing in the dark and thereby allowing finding the sock in the dark.

* * * * *